US005743335A

United States Patent [19]

Bussear

[11] Patent Number: 5,743,335

[45] Date of Patent: Apr. 28, 1998

[54] WELL COMPLETION SYSTEM AND METHOD

[75] Inventor: Terry R. Bussear, San Jose, Tex.

[73] Assignee: Baker Hughes Incorporated, Houston, Tex.

[21] Appl. No.: 534,552

[22] Filed: Sep. 27, 1995

[51] Int. Cl.[6] ..... E21B 33/13

[52] U.S. Cl. ..... 166/285; 166/116; 166/177.4; 166/242.7

[58] Field of Search ..... 166/291, 285, 166/116, 115, 114, 177.4, 242.7, 242.6

[56] References Cited

U.S. PATENT DOCUMENTS

| | | | |
|---|---|---|---|
| 3,531,236 | 9/1970 | Braddick et al. | 166/115 |
| 3,934,652 | 1/1976 | Cochran | 166/285 |
| 4,601,343 | 7/1986 | Lindsey, Jr. et al. | 166/242.6 X |
| 4,848,459 | 7/1989 | Blackwell et al. | 166/285 X |
| 4,869,323 | 9/1989 | Stagg | 166/285 |
| 4,942,925 | 7/1990 | Themig | 166/382 |
| 4,966,236 | 10/1990 | Braddick | 166/291 |
| 5,437,330 | 8/1995 | Gambertoglio | 166/289 |

FOREIGN PATENT DOCUMENTS

| | | |
|---|---|---|
| 1597441 | 9/1981 | United Kingdom . |
| 2115860 | 9/1983 | United Kingdom . |
| 2221482 | 2/1990 | United Kingdom . |

OTHER PUBLICATIONS

Baker Oil Tools Catalog, Liner Hangers, 38 pgs.

*Primary Examiner*—Hoang C. Dang
*Attorney, Agent, or Firm*—Browning Bushman

[57] ABSTRACT

The method includes running a liner, production packer and polished bore receptacle (PBR) into a well on the production tubing string, cementing the liner in place by pumping cement through the production tubing string, setting the packer, and optionally thereafter releasing an upper portion of the tubing string from a PBR. A seal assembly isolates the PBR bore from cement exposure during liner cementation. Annular pressure produces a reverse fluid surge and circulating flow to prevent PBR seal area contamination when the tubing string is lifted away from the PBR. A connecting assembly 12 is suspended from a production tubing string 11 to position a liner 17 in a wellbore. The connecting assembly transmits rotational and longitudinal forces from the production tubing string to properly position and cement the liner in the wellbore. The connecting assembly includes a device 20 to limit torque forces on the tubing string, and a longitudinal slip mechanism 28 permits limited longitudinal movement between the connecting assembly and tubing string. A packer 15 is set to seal between the production tubing string 11 and the well casing. An extended length of tubing 11*a* extends below the packer to provide a continuous tubing/liner-casing overlap area for cementation.

23 Claims, 2 Drawing Sheets

WELL COMPLETION SYSTEM AND METHOD

FIELD OF THE INVENTION

The present invention relates generally to the completion of wells. More particularly, this invention relates to an improved method and system for cementing a liner in place within a well and for completing the well in a manner which minimizes the number of trips into and out of the well.

BACKGROUND OF THE INVENTION

Liners are typically used in petroleum recovery operations to case-off new sections of wellbore drilled below an already cased section of the well. The liner is conventionally attached to a drill string and is lowered with a liner hanger and a polished bore receptacle from the drill string through the cased part of the well until the liner is positioned in the open bore. The liner hanger is subsequently set to anchor the top of the liner to the base of the surrounding casing, which previously was fixed within the well.

The liner is conventionally cemented in the wellbore. A fluid cement slurry is pumped down the drill string and circulated up through the open wellbore and into the annulus area between the liner and the casing. A cement annulus is thus formed between the exterior of the liner and the walls of the wellbore, and ideally extends from just below the liner to the base of the liner hanger.

In typical liner hanger installations, the liner hanger is anchored near the base of the previously cemented casing string. The liner is thus suspended directly from the hanger, which in turn is suspended from the casing string. A polished bore receptacle (PBR) is positioned directly above the hanger, and is cemented in place with the liner hanger. This design provides a relatively short "overlap" between the casing and the liner, which makes it difficult to place the proper volume of cement in the overlap area without over-displacing and forcing the cement above the liner hanger and polished bore receptacle.

The liner hanger is typically mechanically set by movement or forces applied by the drill string or is hydraulically set by pressurizing fluid in the drill string. After being set, the anchored liner hanger, polished bore receptacle, and attached liner may be released from the drill string by mechanical or hydraulic activation.

In a typical liner installation, the liner hanger is equipped with a bearing member which permits the liner to be rotated after the liner hanger has been set. Rotation of the liner during the cementation process is employed to improve the final placement of the cement around the liner and thus the quality of the cementing operation. Specialized hanger designs and setting tools operated by the drill string are employed to hang off and rotate the liner.

After the cementing operation and the tripping out of the drilling string, the liner is commonly tied back to the surface with a production tubing string. The PBR provided directly above the liner hanger has a smooth, cylindrical inner bore designed to receive and seal with an external seal assembly carried at the bottom of the tubular which stabs into the liner hanger PBR. Because the open bore of the PBR directly above the conventional liner hanger is exposed when the drill string is separated from the liner hanger, cement which frequently has been pumped above the liner hanger falls into the PBR bore when the drill pipe is disengaged from the hanger. The presence of this debris, as well as mechanical damage to the receptacle occurring when cementing the liner in place, may prevent a seal assembly from subsequently entering or sealing with the receptacle bore. When this occurs, expensive and time consuming clean-up trips and repair procedures are required. The operation of tripping the drill string in and out of the well to condition or repair the PBR and then running in with the production tubing may take days of rig time and cost hundreds of thousands of dollars. To complete the well, a production tubing string may be subsequently tripped in with a production packer which is normally set high above the liner hanger. Typically another PBR is provided for getting on and off the set production packer.

The conventional polished bore receptacle at the upper end of the liner employs a polished bore diameter which is equal or larger than the internal diameter of the liner, so that a liner hanger PBR and sealing assembly do not restrict "full gauge" internal access to the liner. The production tubing string may extend down and seal with the liner PBR. The seal assembly for sealing with the liner PBR must seal the generally significant annular area between the liner PBR bore and the generally smaller outer diameter of the production tubing. This results in large pressure-induced forces acting above and below the seal assembly once the assembly is engaged with the liner polished bore receptacle. Most importantly, the liner PBR/production tubing seal assembly is exposed to normal fluid flow and pressure from the lower producing formation. These pressure-induced forces may impart excessive stresses into the production tubing string, resulting in distortion, burst and/or collapse of the production tubing string.

A typical liner installation employs an anchored production packer in an upper tubing-to-casing annulus to both isolate the liner PBR from full annular hydrostatic pressures, and to absorb and transfer to the casing the compressive tubing axial loads resulting from normal high pressure exposure of the internal piston area between the tubing and liner PBR. The casing may be open from above the liner PBR to below the production packer. Alternatively, a tubular typically smaller in diameter than the production tubing may extend from the production packer to seal with the liner PBR. The typical installation further includes a packer PBR, sized appropriately to the upper tubing, to permit disengagement for fluid circulation, tubing retrieval and accommodation of normal length changes in the tubing string extending to the surface.

During the cementing process, it is important to minimize formation damage by limiting the hydrostatic pressure imposed against the formation to be produced. Factors affecting the hydrostatic pressure include the height of the cement column in the drill string and the pump pressure required to overcome pumping friction pressures. High cement columns and high pump pressures can produce high hydrostatic pressures which may severely damage the producing formation.

The quality of the cementation process is affected by both the velocity and the turbulence of the cement flow as it moves into the annulus between the liner and the surrounding wellbore and casing. A reduction in the velocity and turbulence of the cement flow would result in increased cement movement control and less washout of the borehole as the cement is circulated into the open hole annulus.

The disadvantages of the prior art are overcome by the present invention, and an improved method and system are hereinafter disclosed for cementing a liner in place within a wellbore and more economically completing a well. The technique of this invention minimizes the number of trip-in and trip-out operations, and also provides a reliable cementing operation while minimizing formation skin damage.

SUMMARY OF THE INVENTION

The system and method of the present invention employ a production tubing string rather than a drill pipe string to position a liner in a wellbore and cement the liner in place. The technique of this invention eliminates the conventional liner hanger, liner polished bore receptacle and seal assembly, drill pipe, and associated liner hanger/polished bore receptacle running tools. A production packer and a polished bore receptacle (PBR) are run in with the production tubing string above the liner. A portion of the production tubing extends below the production packer and the polished bore receptacle and forms an extended overlap section between the tubing and surrounding casing in the area below the packer and above the base of the surrounding casing. This extended overlap section provides an ample area for complete cementation between the production tubing and casing while reducing the danger of pumping the cement above the PBR, which is preferably spaced high above the lower end of the casing. Stringers of cement which tend to develop above the cement top during cementation are thus physically isolated from the production packer by the extended overlap, thereby minimizing contamination of the area above the production packer where the PBR is located.

The system and method of the present invention permit the production tubing to be used to position, rotate and/or reciprocate the liner to more reliably position and cement the liner in place. The production tubing connections are threaded and have shouldering metal-to-metal seals which tolerate high torque forces. A torque transmission and torque limiting member transmits torque from the production tubing string to the liner, and disengages when excessive torque is applied to protect the tubing connections. Longitudinal movement between the tubing and liner is permitted by a slip mechanism, which permits longitudinal movement of the production tubing string relative to the liner. The production tubing string may thus be moved during an emergency when cementing the liner, or when normally producing, treating, stimulating, or killing the well. A shear mechanism controls initiation of tubing movement after the liner is cemented.

The system of the invention includes a production packer which may be set without movement of the liner. The packer is connected to the production tubing string so that the annular packer seal initially rotates with the liner when positioning the liner downhole and when rotating the liner during the cementing operations. The packer may thus be set after the liner has been cemented in place. In a preferred form of the invention, the packer contains a small explosive charge which is detonated from the well surface. The setting procedure is independent of well pressure or tubing movement to prevent the packer from setting during the liner placement or cementing operation. The packer is also capable of allowing for the circulation of high density fluids at high flow rates in the annulus between the production tubing string and the casing both before and during the liner cementing operation, and then subsequent setting of the packer without movement of the setting string.

The PBR may be provided with a release system which permits release of the production tubing string by various means, including pressurizing the tubing-to-casing annulus above the PBR. Upon initial separation of the tubing string, a rapid reverse fluid circulation flow is established which purposefully surges and sweeps cement and other contaminants upward into the tubing and away from the bore of the PBR. Specified sealing members at the lower end of the seal assembly withstand this intentional differential pressure unloading technique. The invention thus allows the production tubing string to be re-engaged with the polished bore receptacle without the need for subsequent procedures to clean and redress the PBR.

According to the method of the present invention, the liner is positioned and cemented in place using the production tubing string. For a given well, the volume of cement which may be carried within an axial length of a typical production tubing string is greater than that which may be carried by the same axial length of a typical drill pipe string. Accordingly, the column of cement contained in the drill pipe extends higher than the same volume of cement contained in a production tubing string. The shorter cement column employed according to the method of the present invention produces a lower hydrostatic pressure in the wellbore which is less injurious to the hydrocarbon bearing formation.

Use of production tubing rather than drill pipe to carry the cement to the liner also reduces mud contamination of the cement slurry. Drill strings are typically internally upset at their threaded-end connections, which produces a large number of discontinuities in the flow path of the drill string. The pump-down plugs placed ahead of and behind the cement slurry do not efficiently wipe the constricted areas of the drill pipe. By contrast, a production tubing string which employs premium shouldering, metal-to-metal seals in the threaded-end connections has a substantially uniform central bore which is efficiently wiped by the pump-down plugs. The smooth flow conduit provided by the production tubing also improves the flow of cement in the borehole as well as in the casing-to-liner annulus by eliminating excessive turbulence and velocity in the cement flow. Moreover, by providing production tubing rather than a liner within the set casing, the lap area annulus is increased to obtain a more reliable cementing operation.

The design of the present system eliminates the need for separate liner hangers and setting tools, and permits the use of both oilfield tubulars with smaller outside diameters and larger inside diameters as compared with conventional cementing systems. The PBR may be sized for the production tubing string rather than for the liner, so that it has a smaller outside diameter and a shorter length than the PBR conventionally provided above the liner hanger. This feature permits larger fluid circulation paths which reduces circulating pressure and minimizes formation damage.

From the foregoing, it will be appreciated that a primary object of the invention is to provide a method and system for installing a liner within a well which eliminates the requirement for a liner hanger and a specialized liner-hanger running tool which must be withdrawn from the well prior to running in the final completion equipment. A related object of the invention to eliminate the need for a liner hanger to support the liner and permit rotation of the liner during cementation after the hanger has been set. Since the liner hanger is not required as a suspension device to secure the liner in the wellbore during the cementing operation, no liner hanger bearing members are required to allow the liner to rotate relative to the hanger during the cementing operation. Another object in this invention is to enable continuous circulation throughout all liner placement or drill-down, conditioning and cementing stages. This continuous circulation capability increases wellbore safety and wellbore integrity and control in a manner which is not possible according to conventional techniques wherein a liner hanger and running tool require cessation of mud circulation during disconnection of the running tool prior to commencement of cementing.

Another object of the present invention is to provide a method and system for installing a liner in a well without the normal cement contamination of the liner hanger polished bore receptacle. By eliminating both the liner hanger and the liner PBR above the base of the set casing, subsequent remedial operations required to repair damage to the PBR bore caused during the cementing procedure are avoided. The method and system for installing a liner within a well casing places the PBR high within the casing an adequate distance from the cement-top to substantially minimize or practically eliminate the likelihood of the pumped cement filling the PBR. The technique of this invention also reduces the likelihood of cement stringers which tend to develop above the cement top during cementation.

It is also an object of the present invention to provide a method and system for cementing a liner in a well using a shorter cement column and improved cement flow passages to reduce the hydrostatic head and effective circulating pressures commonly encountered in conventional cementing procedure, thereby reducing the pressure of the cementing fluids acting on the down hole production formation and increasing recovery of hydrocarbons. A related object of the present invention is to improve the quality of liner cementation between both the borehole-to-liner section and the liner-to-casing overlap area by reducing the turbulence and velocity of cement flow with the use of production tubing rather than drill pipe for a cementing string.

It is a significant feature of the present invention that well completion costs may be substantially reduced by eliminating separate, repetitive trips associated with running a liner hanger in a well and thereafter interconnecting the polished bore receptacle with a production tubing string. A related feature of the invention is that the completion costs are substantially reduced by minimizing the likelihood of one or more remedial pipe running trips necessary to restore the mechanical integrity of the liner-to-PBR, or to clean out cement from the PBR.

It is a further feature of the invention to reduce damage to a formation caused by the hydrostatic head of cement. By reducing the hydrostatic head of the cement in the range of from 5% to 8%, formation fracture pressure may not be exceeded, thereby significantly reducing damage to the formation and increasing the recovery of hydrocarbons once the cemented liner is perforated. It is a further feature of the invention to increase the quality of the liner cementing operation by reducing turbulence and velocity of cement flow, and by minimizing the likelihood of cement contamination by well fluids or mud due to poor efficiency of the wiper plugs passing through tubulars with non-uniform internal bores.

It is a related feature of the invention to reduce the pumping pressures required to flow cement into the annulus between the liner and the formation. The annular flow area in the lap section below the production packer and above the bottom of the casing is increased. A relatively short PBR and packer assembly may be used with a smaller outer diameter than conventional systems, thereby resulting in lower effective circulating pressures.

A further feature of the invention is that the production packer is intended to rotate with the production tubing string while the liner is positioned within the wellbore and is cemented in place. The packer is designed to withstand external mud circulation during drilling, circulation, or cementing operations without adversely impacting its subsequent setting and sealing functions. The packer is designed to enable running on the production tubing without requiring additional setting tools. The packer may be normally set in the casing without movement of the central packer body, and may utilize hydraulic pressure downhole for packer-setting energy without an internal port exposed to mud and/or cementing fluids. The packer-setting operation may also be initiated and controlled by a remotely transmitted signal.

Yet another feature of the invention is that the production tubing seal assembly is able to withstand high annulus-to-tubing differential pressures due to the design of the seal assembly and the polished bore receptacle. The PBR may also be provided with a torque transmission and torque limiting device, with a single or multiple shear mechanism, and with an annulus pressure response disconnect device.

It is an advantage of the invention that existing downhole components may be used in much of the system according to the present invention. Another advantage of the invention is the reduction in downhole tools and setting tools required to complete a well. A further advantage of the invention is that the system may be customized for individual wells which require different disconnection and load carrying requirements. Tripping out only a portion of the production tubing may be required to complete the well.

These and further objects, features and advantages of the present invention become apparent from the following detailed description, wherein reference is made to the figures in the accompanying drawings.

DETAILED DESCRIPTION OF PREFERRED EMBODIMENTS

Figure 1:
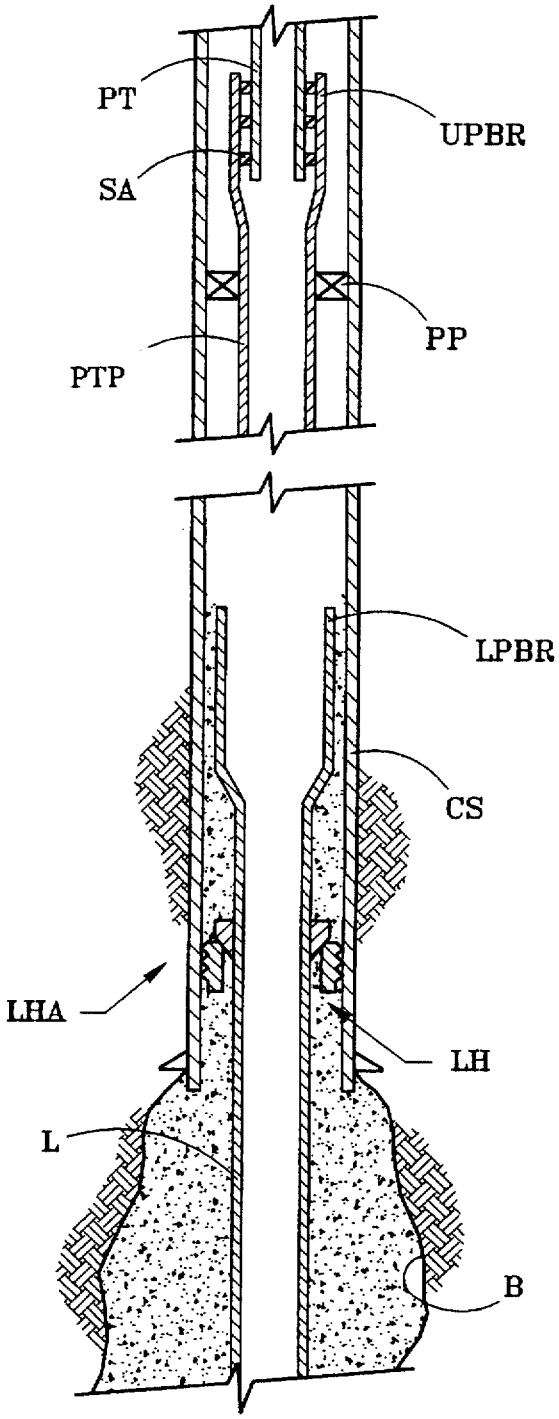
(PRIOR ART) FIG. 1
FIG. 1 is a vertical elevation, partially in section, schematically depicting a conventional liner with a typical tubing string tie back to the well surface.

FIG. 1 illustrates a conventional liner hanger arrangement indicated generally at LHA. A liner hanger LH is illustrated supporting a liner L within a casing string CS, which has previously been cemented or otherwise secured within the well. The liner L extends below the casing string CS and into an open borehole B. A lower polished bore receptacle LPBR is provided immediately above the liner hanger, and opens upwardly toward the well surface (not illustrated).

During the running of the liner L, a drill string and setting tool (not illustrated) are used to lower the liner L, the liner hanger LH, and the lower polished bore receptacle LPBR into the illustrated position within the borehole B. Cement is circulated into the borehole through the drill string and liner L. During this cementing process, it is usually desirable to manipulate the drill string at the surface to rotate and/or reciprocate the liner L as the cement is being displaced into the borehole B. Prior to cementing, the liner hanger LH is set and the drill string is released from the liner hanger. Special weight carrying rotating assemblies in the liner hanger are used to rotate the liner during the cementation.

Cement in the annulus between the liner L and casing CS is frequently over displaced during the cementing process and the cement is circulated up over the top of the lower polished bore receptacle LPBR. This cement and other solids in the drill string-to-casing annulus fall down into the bore of the lower polished bore receptacle LPBR when the drill string and setting tool are released at the completion of the cementation procedure.

After the liner is anchored in place and the drill string removed, the completion or production tubing string PT is lowered into the well with a packer tailpipe PTP, a production packer PP, and the upper PBR. A production packer PP may be spaced 100 meters or more above the liner hanger, and seals between the production tubing string PT and the casing string CS. The upper polished bore receptacle UPBR is provided immediately above the production packer, and allows the production tubing string to be selectively disconnected from the set production packer. The seal assembly SA at the lowermost end of the production tubing string is inserted into the upper PBR. Debris falling into the lower PBR as well as mechanical damage to the lower PBR bore during placement of the liner or release of the drill string may prevent effective sealing of a seal assembly (not shown) with the LPBR. Moreover, attempts at inserting the seal assembly into the bore of the LPBR may damage the seal assembly, thereby preventing proper sealing engagement.

Figure 2:
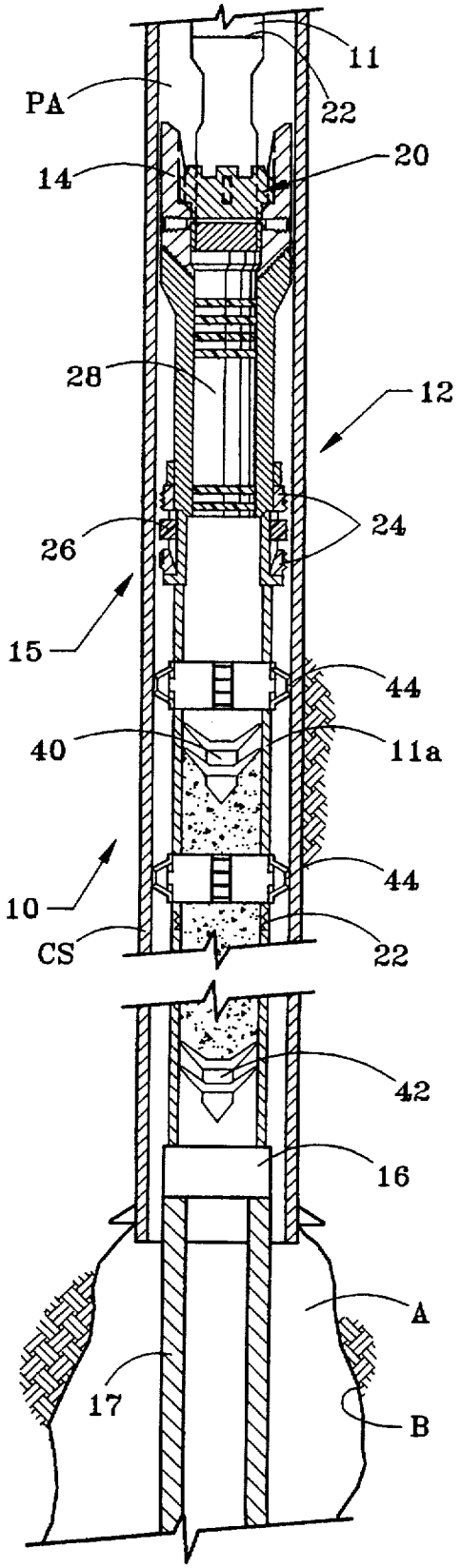
FIG. 2 is a vertical elevation, partially in section, illustrating the assembly of the present invention employing a production tubing string to position the liner, cement the liner in place and set the production packer.

FIG. 2 illustrates one embodiment of the system 10 according to the present invention. A casing string CS extends from the borehole B toward the well surface (not illustrated). The system 10 utilizes a completion or production tubing string 11, which during production ties back to a receiving vessel or transmission line on the surface, to carry a connecting assembly represented generally at 12 into the well. The connecting assembly 12 serves the purpose of both sealing the production tubing string with the set casing and interconnecting and selectively disconnecting the production tubing string from the equipment below assembly 12. The connecting assembly 12, in a general sense, thus performs a function similar to the production packer PP and the upper polished bore receptacle UPBR shown generally in FIG. 1.

Figure 3:
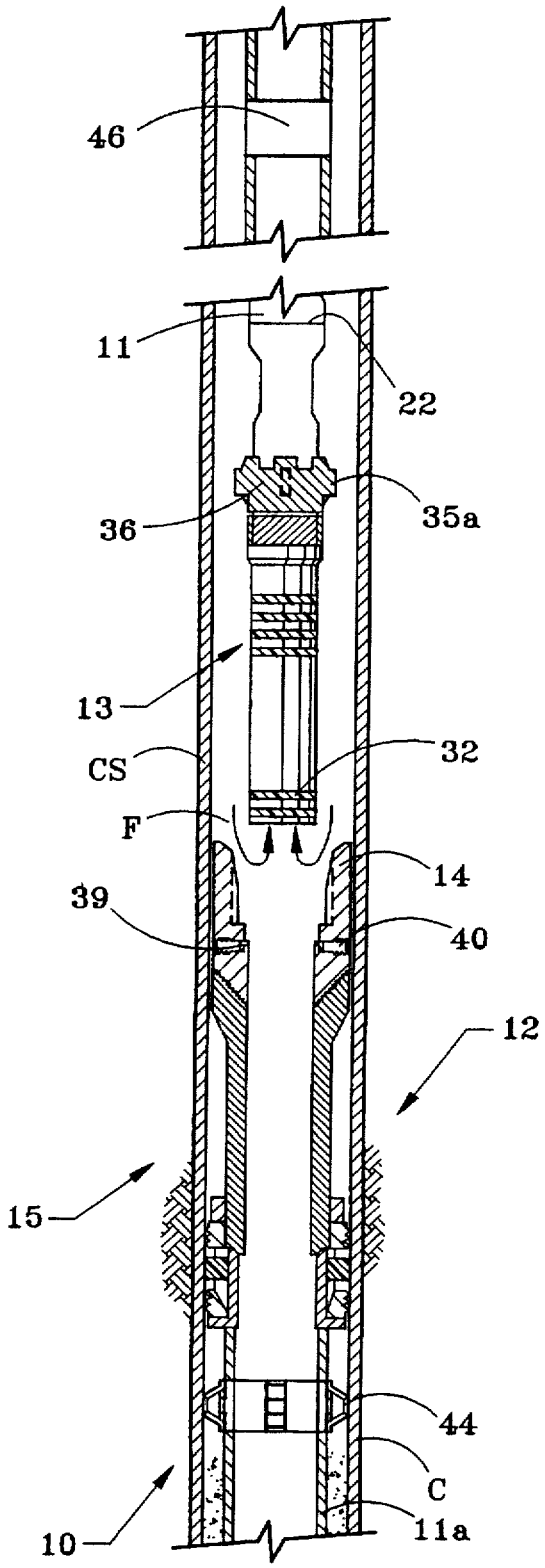
FIG. 3 illustrates the system of the present invention as it appears following release of the production tubing from the polished bore receptacle and showing a reverse circulation of fluid which prevents contamination of the polished bore receptacle.

Referring jointly to FIGS. 2 and 3, the connecting assembly 12 includes a seal assembly 13 which extends between the production tubing string 11 and a polished bore receptacle 14, which is provided above a production packer 15. The system 10 also includes a section of production tubing 11*a* extending from below the packer 15 to the liner 17. The production tubing section 11*a* provides an extensive overlap area between the O.D. of the production tubing 11*a* and the I.D. of the casing string CS for receiving cement to both improve cementation between the lower end of the casing C and the liner 17, and to protect the PBR 14 from contact with the cement.

A plurality of centralizers 44 are preferably provided along the length of the tubing section 11*a* between the packer 15 and the liner 17 to centralize the tubing section 11*a* within the casing string CS. A crossover sub 16 connects the lowermost end of the tubing section 11*a* with the liner 17, which extends downwardly into the open borehole B. Those skilled in the art will appreciate that, in many applications, the liner 17 does not extend into a vertical borehole as shown in the figures, and instead extends into an inclined or substantially horizontal portion of the borehole. In either case, the production tubing string 11 is manipulated from the well surface to position the liner in place within the borehole and cement is passed through the production tubing string to cement the liner within the borehole.

FIG. 2 illustrates the liner 17 in position within the borehole B before being cemented into place. During the process of lowering the liner into position, the production tubing string 11 may be rotated and reciprocated as required to force the liner into proper position. A clutch mechanism or other torque transmitting and torque limiting device 20 as discussed further below is preferably positioned in the connecting assembly 12 and permits the rotary forces of the production string 11 to be transmitted to the liner 17. In the event that the liner 11 should lodge or should otherwise become difficult to rotate, the device 20 will release to permit rotation of the string 11 without corresponding movement of the liner 17. This feature protects threaded connections in the string 11, such as 22, from being damaged due to over-torquing.

Cement is pumped from the surface through the production tubing string 11 and out of the bottom of the liner 17 into an annulus A between the borehole B and the liner 17. In the process, upper and lower tubing wiper plugs 40 and 42 may be employed to provide separation between the cement and the drilling fluids. While the cementing is in progress, the liner 17 may be rotated and/or reciprocated by manipulating the tubing string 11 to ensure proper disbursement of the cement in the annulus A.

By pumping cement through a production tubing string rather than through a drill pipe string, the hydrostatic head of the pumped cement may be reduced, thereby minimizing damage to the formation. Those skilled in the art will appreciate that the internal diameter of a suitable production tubing is larger than the internal diameter of drill pipe conventionally used for transmitting cement to the liner and into the borehole. For any given well application, the same volume of cement may thus be pumped through the liner and into the borehole with a lower hydrostatic head due to the larger internal diameter of production tubing used for each well as compared to the size of the drill pipe string used in drilling and servicing the same well. Also, upper and lower wiper plugs which are used to separate the cement from other wellbore fluids frequently cannot do an efficient job of wiping the interior surface between the joints of drill pipe due to the varying internal bore diameters at the drill pipe connections. By utilizing production tubing rather than drill pipe to pump the cement to the liner, more efficient wiping of the plugs is obtained due to the substantially uniform diameter of each of the joints of tubing both along the full length of each joint and between adjoining tubular joints connected by a high strength tubing connection. A suitable tubing according to the present invention may include both Model 521 tubing manufactured by Hydril or tubing manufactured with Atlas Bradford Model DSS-HTC threads. The desired tubing has substantially uniform internal diameter bores and high pressure metal-to-metal seals, and is able to transmit reasonably high torque and permit efficient wiping of the cement slurry.

Those skilled in the art will appreciate that a substantial axial spacing of, for example, 300 meters may typically exist between the production packer and the lowermost end of the casing string CS. In the prior art, as shown in FIG. 1, a packer tailpipe PTP conventionally extends between the production packer PP and the liner hanger LH. Using conventional techniques and equipment, both the packer tailpipe PTP and the liner L below the liner hanger LH have an internal bore diameter which is less than the bore of a suitable production tubing section 11*a* which extends between the production packer 15 and the liner 17 according to the present invention. This feature reduces the hydrostatic head of the cement during the cementation process to prevent formation damage. Equally important, the O.D. of the packer tailpipe PTP of the prior art is greater than the O.D. of the production tubing section 11*a* of the present invention. Accordingly, the use of production tubing string 11*a* provides for a thicker annulus which is subsequently filled with cement than the annulus provided according to the prior art, thereby obtaining a more extensive and reliable cementing job and because of the increased volume available to receive cement, reducing the likelihood that cement will be pumped up to an area adjacent the production packer. Also, the threaded end connections of a conventional liner, like the threaded end connections of a drill pipe, provide a high resistance to upward flow of drilling mud or other fluid while the cement is pumped into the well. By using production tubing rather than drill pipe above the production packer, and by using production tubing rather than a liner below the packer, improved flow passages are provided and pump pressure required to pump the cement downhole and to force the well fluid upward to the surface in the annulus within the casing string CS is reduced, thereby again reducing the likelihood that excessive pressure will damage the formation.

The packer 15 is set after cementing with the use of a surface operated setting system (not illustrated) contained within the packer 15. The setting system may be designed to actuate a set of slips 24 and an annular packer seal 26 without axial movement of either the production tubing string 11 or the packer 15, which is structurally secured to the cemented liner 17. An example of this signalling system is described in corresponding U.S. patent application Ser. No. 08/386,565 filed on Feb. 10, 1995, and assigned to the assignee of the present application. In the setting mechanism according to this invention, an explosive charge may be contained within the setting mechanism and may be detonated in response to sequential pressure signals sent from the well surface down through the well fluids to the packer. It is important that the packer 15 may be set using positive fluid pressure applied in the annulus between the casing and the production tubing string as the setting force or energy. Internal ports commonly used to set a production packer by increasing internal production tubing fluid pressure would become plugged with cement and prevent the production packer from being reliably set. The packer may thus be set downhole in response to a pressure or pulse signal generated at the surface, and may use positive annulus pressure rather than internal production tubing pressure as the setting force.

As best illustrated in FIG. 3, the packer 15 holds the top of the liner 17 firmly within the surrounding casing C and provides a seal between the casing string CS and liner 17. The packer 15 serves to provide a reliable seal to keep formation fluids from entering the annulus between the casing and the production tubing string 11 in the event that well fluid pressure leaks past the cement surrounding the liner 17. Slips 24 within the packer prevent well pressure above or below the set packer from axially moving the packer within the casing string CS.

The packer 15 is a drilling-compatible packer with an annular seal 26 which rotates with the production tubing string 11 while the liner is positioned downhole and during the cementing process. The annular packer seal 26 is thus keyed or otherwise mechanically interconnected with the mandrel which passes through the packer seal and thus with the production tubing string to rotate in unison. If the annular packer seal were allowed to remain stationary against the side of the casing string while the production tubing string rotated, which is the conventional arrangement for most packers, bearings and seals in the packer would quickly deteriorate. Since the annular packer seal rotates with the production tubing string, mechanical guides or centralizers (not illustrated) may be provided above and below the production packer to reduce the likelihood of the unset annular packer seal engaging the casing during rotation of the production tubing string, thereby minimizing damage to the annular packer seal.

The annular seal 26 of the production packer 15 is also designed to be able to withstand the fluid pressure as mud passes upward past the production packer in the annulus between the casing and the production tubing string. The annular packer seal of the production packer should be both sized and structurally reinforced to withstand this circulation pressure since fluid flows past the unset packer seal while the liner is being positioned downhole and while cement is being pumped through the production tubing string and into the borehole.

It is a feature of the present invention that the polished bore receptacle 14 may have an internal bore diameter which approximates the outer diameter of the production tubing 11, rather than having an internal bore diameter which must accommodate the conventionally larger outer diameter of the packer tailpipe PTP, as shown in the prior art of FIG. 1. For a given well, the polished bore receptacle 14 may thus have a smaller outer diameter and have a shorter axial length than PBRs used in prior systems for the same well, thereby further lowering the pressure required to circulate drilling fluid upward between the casing and the PBR during the cementing operation.

When the tubing string 11 is anchored at the well surface, limited longitudinal movement of the tubing string 11 relative to the cemented liner is permitted by a slip mechanism 28 included in the connecting assembly 12. The slip mechanism 28 allows the tubing to be moved as required to properly set the tubing 11 in the PBR 14 and to lengthen or contract with respect to the PBR during normal producing or treating operations. The production tubing string 11 may thus move with respect to the PBR 14 without jeopardizing the sealing integrity between the liner and the production tubing string. The PBR 14 may accept various types of seals 13 within a slip mechanism 28. Since the internal diameter of the PBR bore approximates the outer diameter of the production tubing string, the seal assemblies 13 are not subject to a high pressure-induced forces when the production tubing string 11 is removed from the PBR 14. During this disconnection operation, the lower seals 32 are able to withstand a high pressure in the annulus PA during the reverse flow of fluids, as discussed below. The PBR 14 is thus hydraulically compatible with the production tubing to minimize pressure differential forces acting on the seals within the slip assembly.

The PBR 14 according to this invention may be designed to transmit both torsional and tensile loads during running and cementing of the liner. As shown generally in FIG. 4, the upper end of the PBR 14 may include a torque transmission mechanism 34, which may consist of circumferentially arranged teeth 37 at the lower end of the production tubing string 11, and mating teeth 38 at the upper end of the PBR 14. The teeth are designed for mating engagement to transmit torque between the production tubing string 11 and the body of the PBR 14, and then to the production tubing 11*a* below the packer 15 and thus to the liner 17. Various types of torque transmission mechanisms may be provided for serving this purpose. The torque transmission mechanism 34 may also include torque-limiting members, such as webs 35*a* extending radially outward from body 36 each for fitting within a slot 35*b* within the PBR 14. The webs and slots are designed to normally allow engagement of the teeth 37 and 38 to transmit torque through the webs 35*a* to the PBR 14. The webs 35*a* may be designed to shear and thereby limit torque to, e.g., 30,000 ft. lbs., thus ensuring that excessive torque is not transmitted to the threads 22 of the production tubing string 11 if the liner L should become stuck downhole. A clutch or other torque transmission and torque limiting mechanism 20 may be provided to reliably transmit torque while limiting torque for the purpose described above.

The assembly 12 may also contain an interlock system designed to sustain anticipated axial loads, both compressive and tensile, which may be expected in the conveyance of the tubing/liner system into the borehole. The interlock system may also release to permit axial movement of the seal assembly 13 relative to the PBR 14 after the liner cementing operation. This axial movement may be for the purpose of complete disengagement of the seal assembly 13 from the PBR 14 as required for fluid circulation or for the addition of components to the tubing string 11, or to control and enable relative movement of the seal assembly 13 within the PBR 14 while maintaining pressure integrity.

Figure 4:
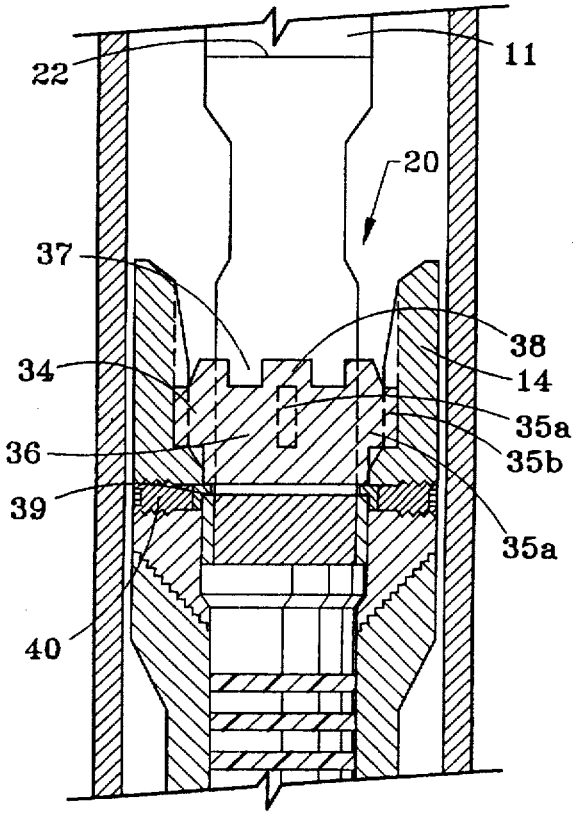
FIG. 4 is a vertical elevation, partially in section, generally illustrating a torque transmitting and torque limiting mechanism and a shear-type release mechanism each provided within an upper portion of a polished bore receptacle.

FIG. 4 illustrates a single ring-shaped shear member 39 for a simplistic embodiment of an interlock system. The shear member 39 is biased radially outward, but is prevented by the upper body of PBR 14 from moving outward further than the position shown in FIG. 4. Once at the surface, members 40 may be threaded further in, thereby compressing the shear member 39 and allowing the seal assembly 13 to be removed from the PBR 14. The assembly 12 may alternatively include a multiple shear system to accommodate tubing stress and tubing length changes. A shear assembly may thus include a plurality of shear rings each intended for shearing upon a selected axial force. During stimulation, remedial recovery operations, or killing of the well, one of the shear rings may be designed to shear upon the application of a selected axial force to the tubing string, thereby allowing the seal assemblies 13 to move up. Further axial movement will then be prohibited by the next shear ring, which will remain in tact until a higher axial force is subsequently applied to the production tubing string. The seal assembly may thus be stoked to shear a ring, and will relatch in a new axial position within the PBR. This sequence may be repeated as often as desired, depending on the number of shear rings. Due to the multiple load-carrying and releasing functions of the interlock system in assembly 12, various mechanism may be employed, either individually or in combination, to achieve the flexibility requirements of varying anticipated downhole conditions and sequencing operations.

The assembly 12 may also include an interlock system which is responsive to annulus pressure for disconnecting the production tubing string 11 from the polished bore receptacle 14. Various mechanisms may be used for this purpose, including a remotely actuated mechanism using hydraulic pressure or pulses. Removal of the tubing string 11 from the PBR 14 may be required, for example, to complete or workover the well. Removal may be effected by applying pressure to the annulus between the production string 11 and the surrounding casing CS. The increased annulus pressure may shear a pin upon reaching a selected pressure, thereby releasing an annular pressure-responsive piston. Axial movement of the piston causes the mechanical release of a collet mechanism which previously connected the production tubing string 11 and the PBR 14. The connecting assembly 12 may thus contains an interlock system with a release mechanism which provides for the release of the production tubing string from the packer 15 and the liner when the annular pressure exceeds that within the tubing 11 by a selected value required to shear the pin and release the piston. Once released, the tubing string 11 and seal assembly 13 may be pulled up into the position illustrated in FIG. 3.

The generation of a positive annulus pressure compared to the production tubing pressure during disconnection of the tubing string 11 from the PBR 14 creates a reverse flow of fluid as indicated by the arrows F in FIG. 3, thereby sweeping any debris or other contaminants up into the tubing and away from the PBR 14. This reverse circulation is continued until the solids in the well fluids have been removed, at which time the tubing string may be withdrawn. The seal assembly 13 is equipped with lower seals 32 which are designed to withstand high differential pressure unloading conditions, which occur in the condition described above where there exists a positive pressure differential between the annulus and the flow path of the tubing 11. The seals 32 are also designed to withstand the reverse flow of the well fluids which occurs immediately upon separation of the seal assembly 13 from the PBR 14. A significant feature of this invention is that fluid circulation may continue throughout the liner placement and cementing operations. According to prior art techniques, circulation was discontinued when disconnecting the running tool from the liner PBR prior to the cementing operation. By allowing for continuous circulation, wellbore safety is enhanced and wellbore integrity and control is increased.

If required, a portion of the production tubing string 11 may be tripped out and then tripped back in to install a safety valve 46, as shown generally in FIG. 3. At the same time, other equipment may be installed at a position above the set production packer 15. A conventional downhole tool may be used to allow the threads 22 in the production tubing string at a selected axial location to be broken apart, so that only a portion of the production tubing string 11 need be retrieved to the surface. Alternatively, various types of disconnect members may be provided along the length of the production tubing string 11 between the surface and the production packer 15, so that only a portion of the production tubing string 11 may be retrieved to install a safety valve 46 or similar equipment. As a further alternative, the release mechanism discussed above may be activated, and the entire production tubing string tripped out of the well before perforating the production zone.

After setting the packer assembly 15 and hanging off the tubing 11 in the well, a conventional through-the-tubing perforation and completion is performed. A suitable perforating tool (not illustrated) may be lowered through the tubing 11 and into the liner 17 to the subsurface location bearing the hydrocarbons to be produced through the production tubing string. The perforating tool is actuated to cut perforations through the liner wall and surrounding cement and into the formation so that the hydrocarbons in the formation may flow into the liner and through the production tubing string 11 to the well surface.

According to the method of the present invention, a liner, production packer, and a polished bore receptacle may be run in on the production tubing string. The production tubing string is formed from tubing sections with a uniform internal diameter in each tubing section and between adjoining tubing sections. The production tubing string and the mechanically interconnected packer seal rotate together when positioning the liner in the wellbore and during the cement pumping operations. At least a portion of the annular overlap between the production tubing string and the lower portion of the well string is filled with cement during the cement pumping operation. Cement is thus pumped through the production tubing string rather than through a drill pipe string to cement the liner in place. The production packer may then be set with a production tubing already connected to the packer. The production packer is set without moving the tubing string, and preferably is set with annulus pressure utilizing remote initiation of the packer setting sequence in response to pulses or pressure. It should be understood that, in one embodiment of the invention, hydrocarbons are recovered at the surface through the production tubing string. In other embodiments of the invention, the tubing string is technically not a production tubing string, since instead injection fluids may be pumped into the well through this tubing string. In other applications, the tubing string may be utilized for evaluation of the absence of flow or pressure monitoring.

The connecting assembly also preferably includes a disconnecting mechanism for selectively enabling the production tubing string to engage or disengage from the production packer. The connecting assembly may also include an expansion mechanism for accommodating axial travel of the production tubing string 11 relative to the set packer, a torque transmitting device, a torque limiting device, and a shear assembly with one or more shear rings.

Various modifications to the equipment and to the techniques described herein should be apparent from the above description of the preferred embodiment. Although the invention has thus been described in detail for a specific embodiment, it should be understood that this explanation is for illustration, and that the invention is not limited to the disclosed embodiment. Alternative equipment and operating techniques will be apparent to those skilled in the art in view of this disclosure. Modifications are thus contemplated and may be made without departing from the spirit of the invention, which is defined by the claims.

What is claimed is:

1. A method for cementing a liner in a wellbore below a well casing, comprising:

positioning a liner in a wellbore from a tubing string passing through the well casing;

pumping cement through the tubing string and the liner to cement the liner in the wellbore; and setting a packer to seal between the tubing string and the well casing while the liner is positioned within the wellbore.

2. The method as defined in claim 1, wherein:

forming the tubing string of tubing sections each having a substantially uniform internal diameter flow passage throughout its length and between adjoining tubing sections.

3. The method as defined in claim 1, further comprising:

applying a fluid pressure externally of the tubing string greater than fluid pressure within said the tubing string; and mechanically releasing the liner from the tubing string in response to the applied fluid pressure.

4. The method as defined in claim 1, further comprising:

manipulating the tubing string to move the liner while cement is being pumped into the wellbore.

5. The method as defined in claim 4, further comprising:

mechanically interconnecting the tubing string and an annular packer seal on the packer such that the packer seal rotates with the tubing string within the well casing during manipulation of the tubing string.

6. The method as defined in claim 1, further comprising:

circulating well fluid between the packer and the well casing while pumping cement through the tubing string prior to setting the packer.

7. The method as defined in claim 1, wherein setting the packer is performed without moving the tubing string spaced above the packer, and while the liner is cemented in place within the wellbore with the liner structurally fixed to the packer.

8. The method as defined in claim 1, wherein setting the packer includes utilizing annulus pressure between the tubing string and the well casing to set the packer.

9. The method as defined in claim 1, further comprising:

extending the tubing string below the packer, whereby a tubing-to-casing annular overlap area is formed between a lower portion of the tubing string and a lower portion of the well casing; and pumping cement includes positioning cement in the overlap area.

10. A method of installing a liner in a wellbore, comprising:

positioning a liner, a packer, and a tubing disconnect within the wellbore from a tubing string;

pumping cement through the tubing string and the liner to cement the liner in the wellbore while circulating well fluid upward past the packer and the tubing disconnect in the wellbore; and setting the packer to seal the tubing string in the wellbore.

11. The method as defined in claim 10, further comprising:

pressurizing an annulus spaced exterior of the tubing string; and activating the tubing disconnect to remove the tubing string from the packer while maintaining the pressure in the annulus to permit fluid flow from the annulus into the tubing string.

12. The method as defined in claim 10, further comprising:

automatically limiting torque transmitted between the tubing string and the liner.

13. The method as defined in claim 10, further comprising:

the tubing disconnect includes a polished bore receptacle with a uniform diameter bore therein and a seal assembly for sealing between the tubing string and the uniform diameter bore; and sizing the uniform diameter bore as a function of an outer diameter of the tubing string to regulate the pressure differential-induced loading on the seal assembly and the tubing.

14. A method for completing a well, comprising:

suspending a production packer and liner in a wellbore below a well casing from a production tubing string;

pumping cement through the production tubing string to cement the liner in the wellbore;

setting the production packer to seal an annulus between a well casing and the production tubing string; and recovering formation fluid through the liner and the production tubing string.

15. A method as defined in claim 14, further comprising:

applying a fluid pressure externally of the production tubing string greater than the fluid pressure within the production tubing string; and releasing the production tubing string from the liner while maintaining the fluid pressure whereby a reverse fluid circulation flow is established to carry well fluids and contaminants upwardly through the production tubing string.

16. The method as defined in claim 14, further comprising:

manipulating the production tubing string to move the liner while cement is being pumped into the wellbore; and circulating well fluid between the production packer and the well casing while pumping cement through the production tubing string prior to setting the production packer.

17. The method as defined in claim 14, further comprising:

removing a portion of the production tubing string from the wellbore to position a safety valve within the production tubing string prior to recovering formation fluid through the liner and the production tubing string.

18. The method as defined in claim 14, wherein setting the production packer includes utilizing annulus pressure between the production tubing string and the well casing to set the production packer.

19. The method as defined in claim 14, further comprising:

providing a crossover sub beneath the production packer and between a lower end of the production tubing string and an upper end of the liner.

20. The method as defined in claim 14, further comprising:

mechanically interconnecting the production tubing string and an annular packer seal on the production packer such that the packer seal rotates with the production tubing string within the well casing.

21. A system for positioning of a liner below a well casing utilizing a tubing string within the well casing, comprising:

a polished bore receptacle for selectively sealing and receiving an upper portion of the tubing string and for disconnection from the upper portion of the tubing string;

a packer associated with the polished bore receptacle for sealing between the tubing string and the well casing, the packer including an annular packer seal mechanically interconnected with the tubing string for rotating with the tubing string;

a torque limiting device to automatically limit torque transmitted between the tubing string and the liner;

a lower portion of a tubing string extending below the packer; and a crossover sub for interconnecting the lower portion of the tubing string and an upper portion of the liner.

22. The system as defined in claim 21, further comprising:

the polished bore receptacle includes an elongate polished bore of a uniform diameter; and a lowermost end of the upper portion of the tubing string includes a seal assembly for sealing engagement with the uniform diameter bore within the polished bore receptacle.

23. The system as defined in claim 21, further comprising:

a disconnect member for controllably disconnecting the upper portion of the tubing string and the polished bore receptable.

* * * * *